US009927749B2

(12) United States Patent
Wazumi et al.

(10) Patent No.: US 9,927,749 B2
(45) Date of Patent: Mar. 27, 2018

(54) FIXING DEVICE AND IMAGE FORMING APPARATUS

(71) Applicant: Konica Minolta, Inc., Chiyoda-ku, Tokyo (JP)

(72) Inventors: Toshihiro Wazumi, Hachioji (JP); Naohiko Hanyu, Kodaira (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/965,282

(22) Filed: Dec. 10, 2015

(65) Prior Publication Data

US 2016/0170340 A1 Jun. 16, 2016

(30) Foreign Application Priority Data

Dec. 12, 2014 (JP) ..... 2014-251762

(51) Int. Cl.
*G03G 15/20* (2006.01)

(52) U.S. Cl.
CPC . *G03G 15/2064* (2013.01); *G03G 2215/2032* (2013.01)

(58) Field of Classification Search
CPC ..... G03G 15/2039; G03G 15/2042; G03G 15/205; G03G 15/2053; G03G 2215/2035
USPC ..... 399/67
See application file for complete search history.

(56) References Cited

U.S. PATENT DOCUMENTS 5,769,411 A * 6/1998 Nakagawa ..... B65H 3/5269 271/121
6,629,659 B1 * 10/2003 Innala ..... B65H 18/26 242/413.5
2011/0058839 A1 * 3/2011 Tsukioka ..... G03G 15/2032 399/67

FOREIGN PATENT DOCUMENTS

JP 2012008487 A 1/2012
JP 2014074879 A 4/2014
JP 2014202901 A 10/2014

OTHER PUBLICATIONS

Translation of Tanda (JP 2012-008487 A) listed in the IDS, publication date: Jan. 12, 2012.*

(Continued)

*Primary Examiner* — Walter L Lindsay, Jr.
*Assistant Examiner* — Frederick Wenderoth
(74) *Attorney, Agent, or Firm* — Cantor Colburn LLP

(57) ABSTRACT

A fixing device includes a first pressing member, a fixing belt, a second pressing member, a load adjustment unit, a tension adjustment unit and a control unit. The first pressing member has an elastic layer. The fixing belt is wound around the first pressing member. The second pressing member presses against the first pressing member via the fixing belt, conveys the recording member and forms a fixing nip. The load adjustment unit adjusts pressing load of the first pressing member and the second pressing member. The tension adjustment unit adjusts tension of the fixing belt. The control unit controls the load adjustment unit so as to change a width of the fixing nip in a recording member conveyance direction and controls the tension adjustment unit so as to change the tension of the fixing belt.

7 Claims, 6 Drawing Sheets

(56) References Cited

OTHER PUBLICATIONS

Translation of Imai (JP 2005-258288 A) listed in the IDS, publication date: Sep. 22, 2005.*
Japanese Notification of Reasons for Refusal corresponding to Application No. 2014-251762; dated Dec. 6, 2016, with English translation.
JPO Decision of Refusal corresponding to Application No. JP2014-251762; dated Apr. 4, 2017.

* cited by examiner

FIXING DEVICE AND IMAGE FORMING APPARATUS

CROSS REFERENCE TO RELATED APPLICATIONS

The present invention claims priority under 35 U.S.C. § 119 to Japanese Application No. 2014-251762 filed Dec. 12, 2014, the entire content of which is incorporated herein by reference.

BACKGROUND OF THE INVENTION

Field of the Invention

The present invention relates to a fixing device and an image forming apparatus.

Description of Related Art

In image forming apparatuses such as copier, printer, multifunction printer and the like, fixing devices for fixing not-yet-fixed images formed by toner onto recording members are used. With regards to such fixing devices, images are fixed onto recording members by forming fixing nips by sandwiching and conveying recording members by fixing rotation members equipped with heating units such as halogen heaters inside thereof, images being already formed on the recording members. As for the fixing rotation members, a pair of rollers including a heating roller equipped with a heating unit and a pressing roller, a device formed by winding a fixing belt around a plurality of rollers, and the like are used.

In a fixing device, fixing conditions suitable to various recording members are set in order to adapt to various types of recording members. For example, in order to fix a toner image onto a thick paper with heavy basis weight, there is a need to increase heat supply to the thick paper whose heat capacity is large. Therefore, fixing to such thick paper is assured by increasing the fixing temperature.

As for a technique relating to fixing device, JP 2012-8487A suggests a configuration including a tension roller which gives tension to a fixing belt which is wound around a heating roller so as to stabilize the distance between the heating mechanism, which heats the fixing belt and the heating roller, and the fixing belt. With such configuration, a preferable fixing of toner images can be realized.

However, there is a large difference in set fixing temperatures for thick paper whose heat capacity is large and thin paper whose heat capacity is small. Therefore, in a case of a job that requires switching between different paper types, there has been a problem that the productivity of printed documents decreases due to the time waiting for switching to the fixing temperature suited for thick paper from the fixing temperature suited for thin paper and vice versa being long.

In order to shorten the time waiting for switching the fixing temperature, the difference in the fixing temperature needs to be made small and the fixing nip width needs to be made large to make the heating amount accord with the conventional fixing condition when the fixing temperature of thick paper is to be decreased so as to approach the fixing temperature of thin paper. However, even if it is desired to increase the load in order to widen the fixing nip width, the fixing nip width cannot be widened since the change amount of the nip width is already at its utmost limit and cannot be widened anymore. Therefore, in order to make the difference in fixing temperatures be small, the fixing temperature of thin paper needs to be increased so as to approach the fixing temperature of thick paper. In order to increase the fixing temperature of thin paper, the nip width needs to be made small by decreasing the load so that the heating amount accord with the conventional fixing condition. However, if the load is decreased, the curvature of the fixing belt near the exit side of the nip is to be small as a side effect and the separability deteriorates.

Deterioration in separability due to decreasing the load occurs according to the following mechanism. FIG. 6A shows a configuration of a fixing device when a piece of thick paper is to be fed. FIG. 6B is an enlarged view of the part near the exit side of the nip in the fixing device when a piece of thick paper is to be fed.

The fixing device 120 includes a heating roller 130, an upper pressing roller 140, an endless fixing belt 150, an inlet roller 160 and a lower pressing roller 170. The upper pressing roller 140 includes an elastic layer 141 formed of a heat-resistant rubber or the like, for example. The heating roller 130, the lower pressing roller 170 and the inlet roller 160 are arranged by having predetermined distances therebetween. The fixing belt 150 is wound around the heating roller 130, the upper pressing roller 140 and the inlet roller 160. The lower pressing roller 170 is arranged so as to press against the fixing belt 150 in the region where the fixing belt 150 and the upper pressing roller 140 are in contact with each other. At the part where the fixing belt 150 and the lower pressing roller 170 are in contact with each other, the fixing nip 180 is formed in an upward convex shape.

At the fixing nip 180, the lower pressing roller 170 presses against the elastic layer 141 of the upper pressing roller 140 so as to dent. As shown in FIG. 6B, a part 142 (hereinafter, referred to as "bulged part") which is formed in a downward convex shape having a large curvature is formed near the end on the exit side of the fixing nip 180 with respect to the recording member conveyance direction, the bulged part being a deflection in the elastic layer 141 of the upper pressing roller caused by the pressing of the lower pressing roller 170. The fixing belt 150 near the end on the exit side of the fixing nip 180 is tightly attached along the downward shape of the bulged part 142 and is formed in a shape having a large curvature that enables curvature separation. Therefore, such configuration is effective in terms of separability.

On the other hand, FIG. 7A shows a configuration of the fixing device when a piece of thin paper is to be fed and FIG. 7B is an enlarged view of a part near the exit side of the nip in the fixing device when a piece of thin paper is to be fed. As shown in an enlarged view of the bulged part 142 in FIG. 7B, when switching to the fixing temperature of thick paper to the fixing temperature of thin paper, if the width of the fixing nip 180 is made small by decreasing the load, the pressure from the lower pressing roller 170 is weakened and the downward convex shape of the bulged part 142 becomes small. Therefore, the curvature of the fixing belt 150 becomes smaller so as to return to the original circumferential curvature of the upper pressing roller 140 and the separability deteriorates.

SUMMARY OF THE INVENTION

The present invention is made in view of the above problems in the conventional technique, and a main object is to provide a fixing device and an image forming apparatus which can prevent the productivity from decreasing by making the difference in the fixing temperatures which are set according to types of paper be small and shorten the time needed for switching the fixing temperature and prevent fixing and separation from deteriorating.

In order to achieve the above object, according to one aspect of the present invention, there is provided a fixing device, including: a first pressing member having an elastic layer; a fixing belt wound around the first pressing member; a second pressing member which presses against the first pressing member via the fixing belt and forms a fixing nip, the second pressing member and the fixing belt sandwiching a recording member to convey the recording member; a load adjustment unit which adjusts pressing load of the first pressing member and the second pressing member; a tension adjustment unit which adjusts tension of the fixing belt; and a control unit which, on a basis of information on the recording member, controls the load adjustment unit so as to change a width of the fixing nip in a recording member conveyance direction and controls the tension adjustment unit so as to change the tension of the fixing belt.

Preferably, in the fixing device, the control unit, on the basis of the information on the recording member, changes an adjustment value of the load adjustment unit and changes an adjustment value of the tension adjustment unit. Preferably, in the fixing device, the information on the recording member is a basis weight, and, in a case where the basis weight is smaller than or equal to a predetermined value, the control unit controls the load adjustment unit so that a width of the fixing nip in the recording member conveyance direction be small and controls the tension adjustment unit so as to lower the tension of the fixing belt.

Preferably, the fixing device further includes a guiding unit which is arranged at a position suitable to separate the fixing belt from the first pressing member, the position being on an inner circumference of the fixing belt and being on an entrance side of the fixing nip with respect to the recording member conveyance direction of a piece of paper fed into the fixing nip.

Preferably, in the fixing device, the control unit moves the guiding member on a basis of controlling of the load adjustment unit and the tension adjustment unit.

Preferably, in the fixing device, the guiding member is arranged at a position tilted 40 degrees toward a direction approaching the first pressing roller with a point in an upper stream side of the fixing nip in the recording member conveyance direction being a center and a first straight line that passes through the point in the upper stream side and a point in a downstream side of the fixing nip in the recording member conveyance direction being a reference line.

According to another aspect of the present invention, there is provided an image forming apparatus, including: a toner image forming unit which forms a toner image on an image supporting body; a transfer unit which transfers the toner image formed by the toner image forming unit onto a recording member; a first pressing member which includes an elastic layer; a fixing belt which is wound around the first pressing member; a second pressing member which presses against the first pressing member via the fixing belt and forms a fixing nip, the second pressing member and the fixing belt sandwiching the recording member to convey the recording member; a load adjustment unit which adjusts pressing load of the first pressing member and the second pressing member; a tension adjustment unit which adjusts tension of the fixing belt; and a control unit which, on a basis of information on the recording member, controls the load adjustment unit so as to change a width of the fixing nip in a recording member conveyance direction and controls the tension adjustment unit so as to change the tension of the fixing belt.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS (Configuration of Image Forming Apparatus)

Figure 1:
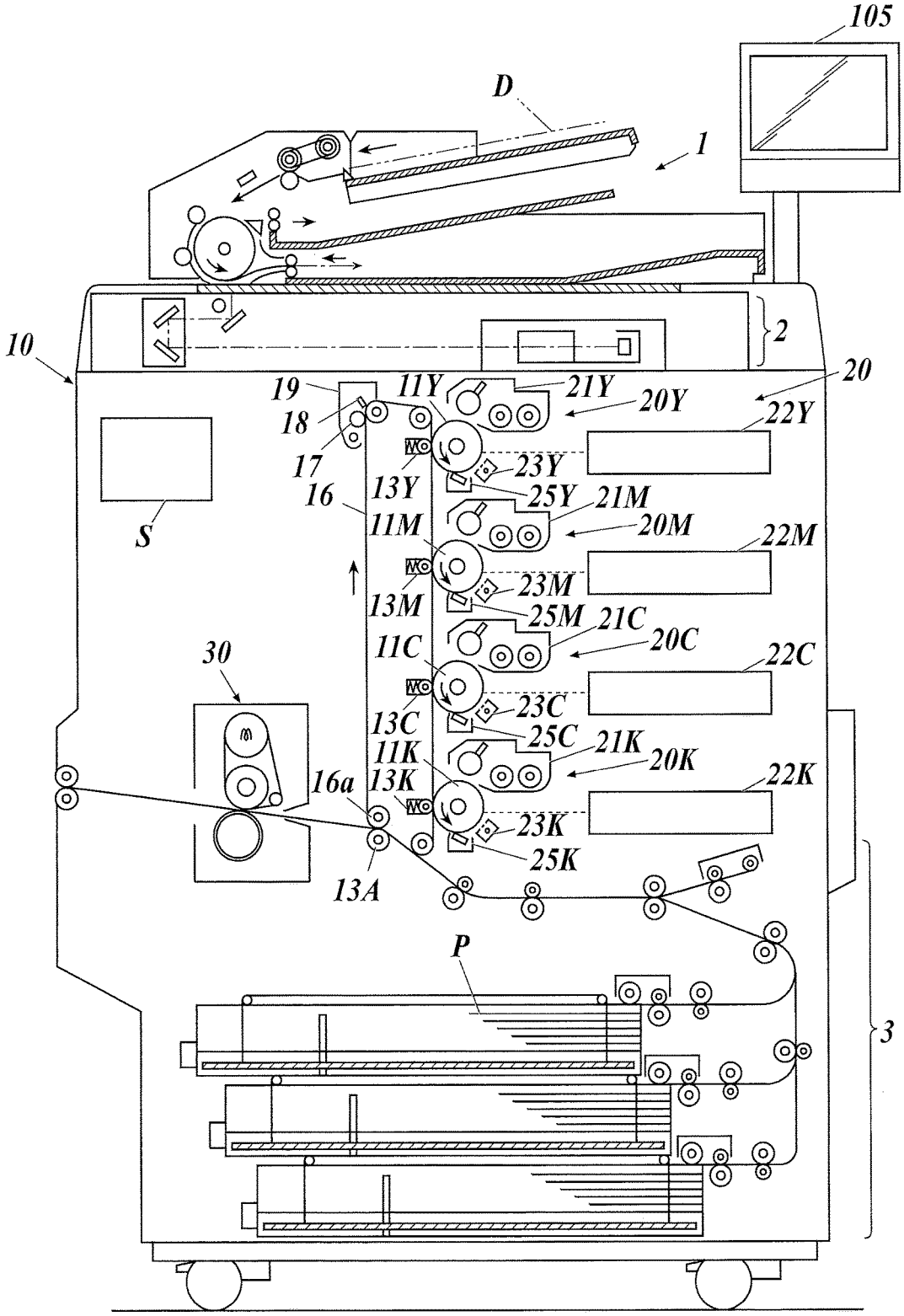
FIG. 1 is a cross-sectional view showing an outline configuration of an image forming apparatus according to the present invention.

FIG. 1 is an image showing an outline configuration of an image forming apparatus 10.

The image forming apparatus 10 includes an automatic document carrier 1, a scanner 2, a paper feeder 3, an image forming unit 20, a fixing device 30, a control unit S, an operating display unit 105 and the like.

The automatic document carrier 1 conveys documents D, which are placed on the document tray, one by one to a predetermined conveyance path.

The scanner 2 emits light to a document D which is conveyed and receives the reflection light which is reflected off the document D. The scanner 2 converts the received light signal to an electric signal (image data) and outputs the converted image data to the image forming unit 20.

In the paper feeder 3, recording members P are stored in a plurality of trays. The paper feeder 3 supplies the recording members P to the image forming unit 20 via predetermined conveyance paths.

The image forming unit 20 includes four sets of image forming units 20Y, 20M, 20C and 20K which form images of yellow (Y), magenta (M), cyan (C) and black (B), respectively. A color image is formed by forming a toner image of each color on a photoreceptor drum 11 corresponding to each color on the basis of the image data, transferring the toner image of each color on the intermediate transfer belt 16 by a primary transferring unit 13 and superimposing the individual images on each other. The image forming unit 20 performs the series of image forming operation from performing the secondary transferring of the color image onto a recording member P, the primary transferring being already performed on the color image, to fixing the image.

The configuration and operation of the surroundings of the photoreceptor drum 11 will be described briefly. Here, the image forming unit 20Y of yellow (Y) will be described and description of other image forming units of other colors will be omitted since their configurations are similar to that of the image forming unit 20Y of yellow (Y).

A charging unit 23Y uniformly charges the surface of the photoreceptor drum 11Y.

An exposure unit 22Y exposes an area in the surface of the photoreceptor drum 11Y where toner is to be attached and forms an electrostatic image by removing the electricity in the exposed area.

A developing unit 21Y develops a toner image by attaching toner to the electrostatic image on the photoreceptor drum 11Y.

The primary transfer unit 13Y applies a bias voltage of polarity that is opposite to the polarity of toner and transfers the toner image which is developed on the photoreceptor drum 11Y onto the intermediate transfer belt 16.

A cleaning unit 25Y removes the residual toner which is attached to the photoreceptor drum 11Y not being transferred to the intermediate transfer belt 16 with a blade or the like.

The intermediate transfer belt 16 is an endless belt and is wound around a plurality of rollers and is supported so as to move. The toner images of different colors which are formed in the image forming units 20Y, 20M, 20C and 20K are sequentially transferred onto the moving intermediate transfer belt 16 by the primary transfer units 13Y, 13M, 13C and 13K. Then, the color image (toner image) formed by the layers of different colors (Y, M, C, K) being superimposed on each other is formed on the intermediate transfer belt 16.

The intermediate transfer belt 16 includes an intermediate transfer cleaning unit 19 having a belt cleaning roller 17 and a belt cleaning blade 18 which come in contact with the surface of the intermediate transfer belt 16 so as to slide on the surface thereof. After the secondary transfer, the residue that remains on the surface of the intermediate transfer belt 16, including the residual toner, is scraped by the belt cleaning roller 17 and the belt cleaning blade 18 to be removed.

A secondary transfer roller 13A is arranged so as to abut a secondary transfer opposite roller 16*a* via the intermediate transfer belt 16. By a recording member P passing through the secondary transfer nip which is formed between the secondary transfer roller 13A and the secondary transfer opposite roller 16*a*, the toner image on the intermediate transfer belt 16 is to be secondarily transferred onto the recording member P. When the image forming operation is in process, the secondary transfer roller 13A abuts the secondary transfer opposite roller 16*a*. However, when the image forming operation ends, the secondary transfer roller 13A separates from the secondary transfer opposite roller 16*a*.

On the side of the secondary transfer roller 13A from where recording members P are to be output, the fixing device 30 is arranged. The fixing device 30 fixes the toner image on the conveyed recording member P by sandwiching and conveying the recording member P on which the toner image is formed. The recording member P on which the toner image is fixed is output outside of the image forming apparatus 10.

The above-mentioned units of the image forming apparatus 10 are connected to a control unit S and they are controlled by the control unit S as needed.

The operating display unit 105 is a touch panel formed of a display such as LCD (Liquid Crystal Display), organic ELD (Electro Luminescence Display) or the like. This operating display unit 105 displays instruction menu for a user, information relating to the obtained image data and the like.

(Block Diagram of Controlling in Image Forming Apparatus)

Figure 2:
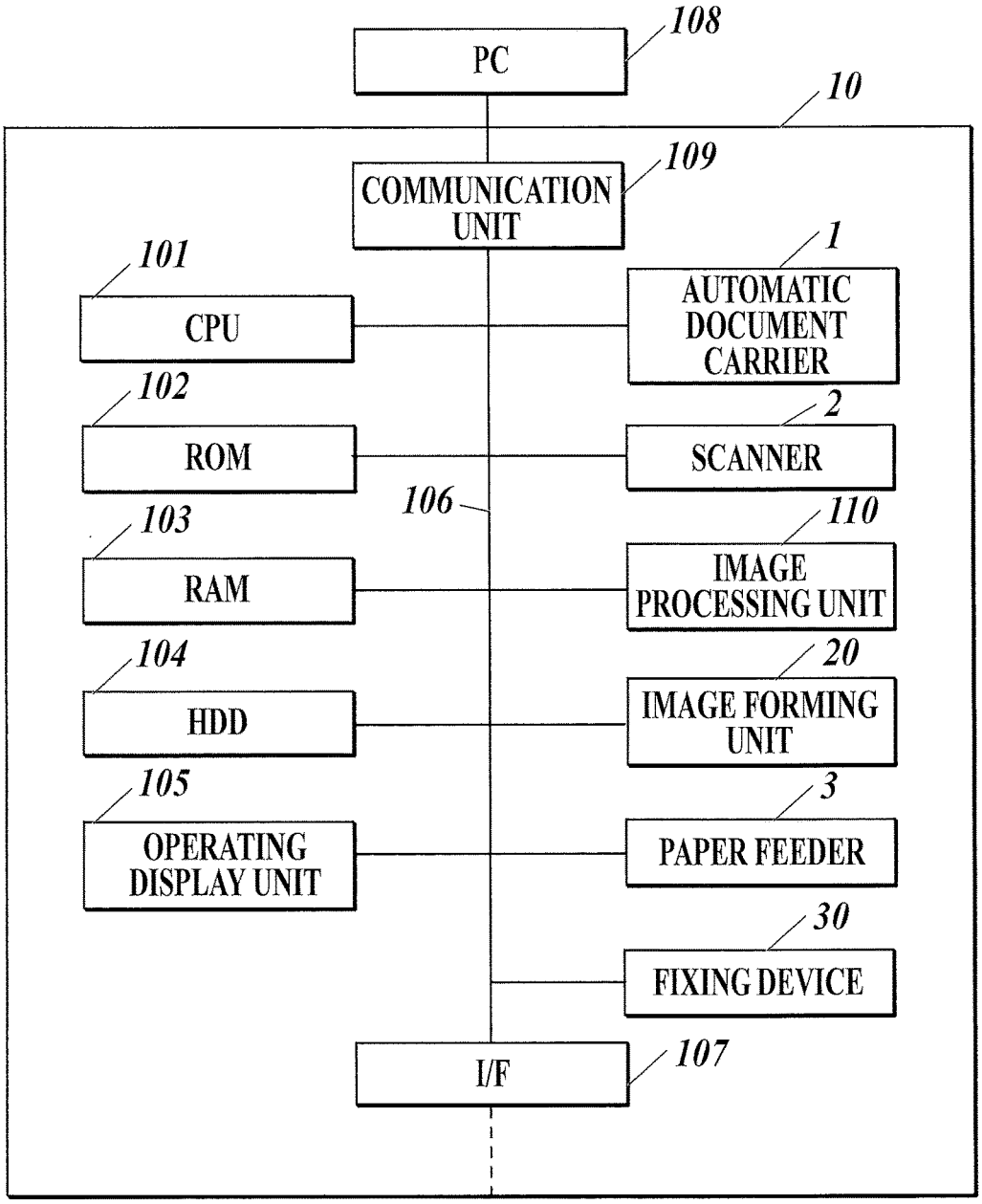
FIG. 2 is a block diagram showing controlling of the image forming apparatus according to the present invention.

FIG. 2 shows a block diagram of connection relating to the controlling in the image forming apparatus according to the invention. The image forming apparatus 10 includes, for example, a CPU (Central Processing Unit) 101 which integrally controls each part of the image forming apparatus 10, a ROM (Read Only Memory) 102 for storing programs and the like which are to be executed by the CPU 101 and a RAM (Random Access Memory) 103 which is to be used as a working region for the CPU 101. The image forming apparatus 10 further includes a HDD (Hard disk drive) 104 as a large capacity storage device and an operating display unit 105 which handles setting and operation of the image forming apparatus 10.

The CPU 101 is connected with the ROM 102, the RAM 103, the HDD 104 and the operating display unit 105 via system bus 106, and the CPU 101 controls the entire apparatus. Further, the CPU 101 is connected with the automatic document carrier 1, the scanner 2, an image processing unit 110, the image forming unit 20, the paper feeder 3 and the fixing device 30 via the system bus 106. Further, an outside connection device interface (hereinafter called "I/F") 107 to perform communication between the image forming apparatus 10 and external devices outside the image forming apparatus 10 is connected to the system bus 106. For example, in a case where an external device such as a post processing device is connected, the CPU 101 can control the external device via the I/F 107.

In the HDD 104, image data of a document which is read by the scanner 2, image data sent from the PC (Personal Computer) 108 which is an external information processing device, image data which is already output and the like are stored. The operating display unit 105 is a touch panel formed of a display such as LCD, organic ELD or the like. The operating display unit 105 displays instruction menu for a user, information relating to the obtained image data and the like. The operating display unit 105 further includes a plurality of keys. The operating display unit 105 receives input of data such as various instructions, letters, numbers and the like input by a user operating the keys and outputs the input signals to the CPU 101.

The image data that is read by the scanner 2 and the image data sent from the information processing device (PC) which is connected to the image forming apparatus 10 are sent to the image processing unit 110 to be processed.

The image processing unit 110 performs image processing such as shading correction, image density adjustment, image compression and the like on the received data as needed.

The image forming unit 20 receives the image data on which image processing is performed by the image processing unit 110, performs exposure to the photoreceptor drum 11 by the exposure unit 22 and developing by the developing unit 21 on the basis of the image data, and forms an image on a recording member P.

The communication unit 109, for example, receives job information which is sent from the PC 108 via a communication wire. Then, the communication unit 109 sends the received job information to the CPU 101 via the system bus 106.

(Configuration of Fixing Device)

Figure 3:
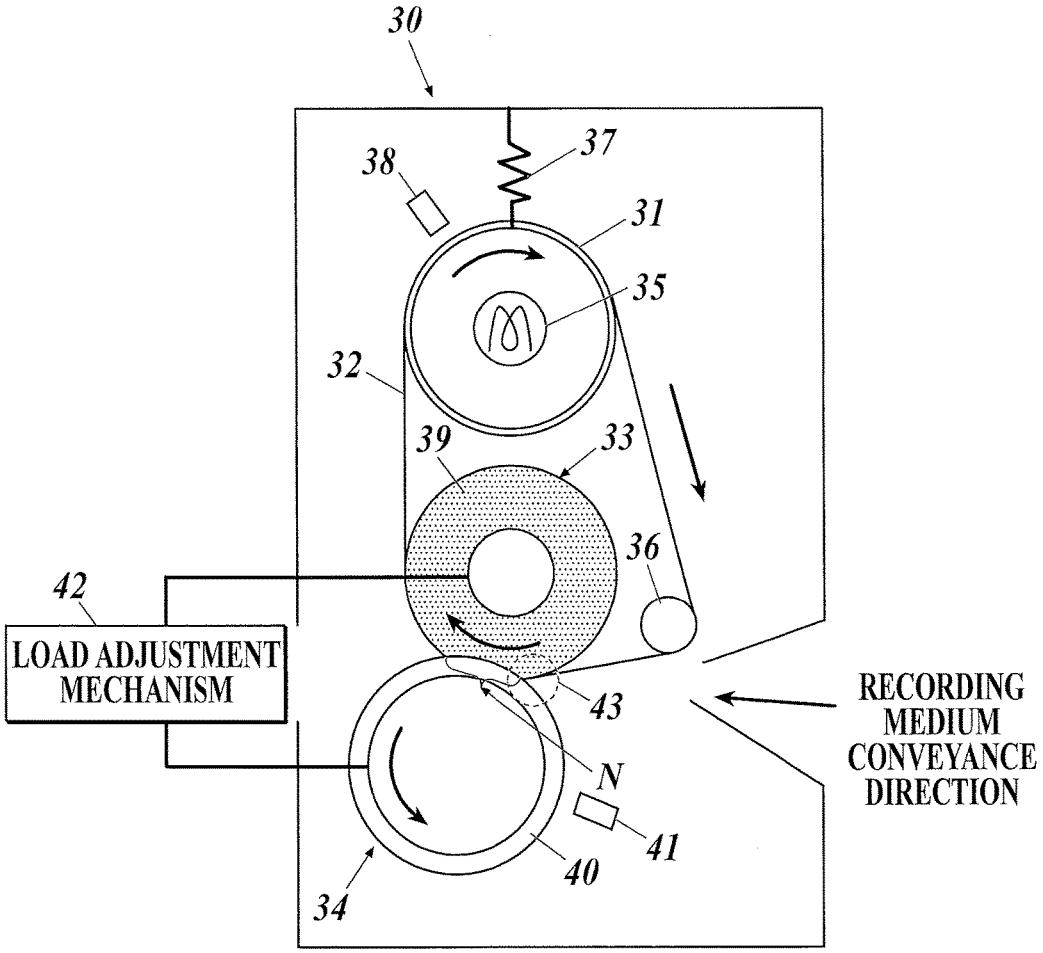
FIG. 3 is a cross-sectional view showing an outline configuration of a fixing device according to the present invention.

FIG. 3 shows an outline configuration of the fixing device according to the embodiment. Here, in the embodiment, "thin paper" refers to a recording member whose basis weight is 128 gsm or less and "thick paper" refers to a recording member whose basis weight is larger than 128 gsm. Further, the standard setting (default) of fixing condition in the after-mentioned fixing device is set to the condition that applies to feeding a piece of thick paper.

The fixing device 30 includes a heating roller 31, a fixing belt 32, an upper pressing roller 33, a lower pressing roller 34 and an inlet roller 36.

The heating roller 31 includes therein a halogen heater 35 which extends in the axis direction as a heating device for heating the fixing belt 32. The halogen heater 35, for example, is formed as a resin coated hard roller where the outer surface of its cylindrical metallic core is coated with 30 μm thick PTFE (polytetrafluoroethylene), the cylindrical metallic core having the thickness of 4 mm and being formed of aluminum or the like. The external diameter of the heating roller 31 is 70 mm, for example.

The halogen heater 35 is arranged inside the heating roller 31 and energization of the halogen heater 35 is controlled by the after-mentioned control unit S. The heating roller 31 is heated by the halogen heater 35 and as a result, the fixing belt 32 is heated.

The fixing belt 32 may be configured so as to be heated by induction heating (IH) or by a resistance heating element.

The spindle axis of the heating roller 31 can move in the up and down directions. A tension spring 37 is hooked to the heating roller 31 and the heating roller 31 is biased upward. Therefore, if the biasing force of the tension spring 37 is changed, the tension of the fixing belt 32 changes. As the driving source for changing the biasing force of the tension spring 37, a solenoid or a motor can be used. The biasing force of the tension spring 37 is controlled by the control unit S. In the HDD 104, a correlation table of biasing force and various types of paper is stored in advance. On the basis of paper type information being input, the control unit S determines the biasing force value using the correlation table. The control unit S can realize the tension of fixing belt 32 that corresponds to the paper type by controlling the tension spring 37 to change the biasing force value.

The fixing belt 32 is an endless belt. For example, 70 μm thick PI (polyimide) is used as the base, the outer surface of the base is covered with 200 μm thick heat-resistant silicone rubber (hardness JIS-A15°) as an elastic layer, and further coated with 30 μm thick PFA (perfluoroalkoxy), the PFA having low friction and being heat-resisting. The external diameter of the fixing belt 32 is 120 mm, for example. The fixing belt 32 is wound around the heating roller 31 and the upper pressing roller 33 with tension of 250N.

The fixing belt 32 comes in contact with a recording member P on which the toner image is formed and the recording member P is heated at a fixing temperature (for example, 180 to 210° C.). Fixing temperature is the temperature for supplying heat required to melt the toner on the recording member P and this temperature differs according to the type of the recording member P on which an image is to be formed. Near the heating roller 31, a temperature sensor 38 which detects the temperature of the heating roller 31 via the fixing belt 32 is arranged, and the control unit S controls the fixing temperature on the basis of the temperature information detected by the temperature sensor 38.

The upper pressing roller 33 is configured as a resin coated soft roller where the solid metallic core of metal such as iron is coated with 20 mm thick heat-resistant silicone rubber (hardness JIS-A10°) as the elastic layer 39 and further coated with 30 μm thick PTFE, the PTFE having low friction and being heat-resisting. The external diameter of the upper pressing roller 33 is 70 mm, for example.

The lower pressing roller 34 is formed by coating the outer surface of the cylindrical core 40 having the thickness of 4 mm formed of aluminum or the like with 2 mm thick heat-resistant silicone rubber (hardness JIS-A15°) as an elastic layer and further coating with 30 μm thick resin layer of PFA tube as a release layer. The external diameter of the lower pressing roller 34 is 70 mm, for example. Further, a temperature sensor 41 for detecting the temperature of the lower pressing roller 34 is provided and the temperature of the lower pressing roller 34 is controlled by the control unit S. The controlled temperature of the lower pressing roller 34 is 80 to 120° C., for example.

The upper pressing roller 33 and the lower pressing roller 34 are arranged in a state where total load of 2200N is applied by a load adjustment mechanism 42 via the fixing belt 32, for example, and a fixing nip N as a pressed part between the upper pressing roller 33 and the lower pressing roller 34 is formed. In the HDD 104, a correlation table of the widths of the fixing nip N corresponding to different types of paper is stored in advance, and the control unit S determines the specified value of the width of the fixing nip N using the correlation table when the paper type information is input. By changing the width of the fixing nip N to a specified width by controlling the load adjustment mechanism 42, the control unit S can realize the fixing nip N corresponding to the type of paper.

The fixing nip N in the embodiment indicates the width at the contacting part in the paper feeding direction which is formed by the upper pressing roller 33 and the lower pressing roller 34 pressing each other. The fixing nip N is set to 25 mm when a piece of thick paper is to be fed The fixing speed of the fixing device 30 is 500 mm/s. The fixing speed is the speed at which the recording member P passes through the fixing nip N which is formed by the upper pressing roller 33 and the lower pressing roller 34.

The inlet roller 36 is a metallic roller where a solid core formed of stainless steel (SUS416) or the like is coated with 30 μm thick PTFE. The inlet roller 36 guides the fixing belt 32 so that the bulged part of the elastic layer 39 of the upper pressing roller 33 which is formed on the entering side of the fixing nip N where the recording member is to be fed in by the pressing of the lower pressing roller 34, the bulged part being a deflection forming a downward convex shape part (bulged part) 43 due to pressing, be separated from the fixing belt 32. By having the inlet roller 36, the winding amount of the fixing belt 32 with respect to the bulged part 43 becomes smaller and therefore the fixing belt 32 does not easily become uneven. Thus, the recording member P can be prevented from having wrinkles when it passes through the fixing nip N in a state where it is sandwiched by the fixing belt 32 and the lower pressing roller 34.

The inlet roller 36 includes an angle adjustment mechanism 44, for example, which sets the arrangement angle of the inlet roller 36 to 40 degrees in response to the change in the fixing nip N. With this angle adjustment mechanism 44, the arrangement angle of the inlet roller 36 can be maintained at the same angle even if the position of the fixing nip N changes according to the type of paper.

Figure 4:
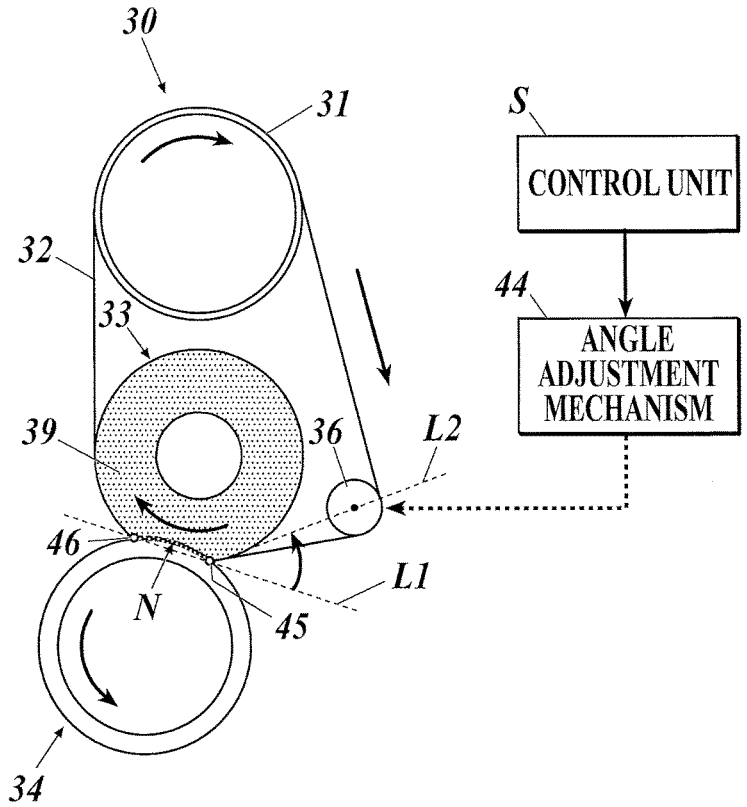
FIG. 4 is a cross-sectional view showing an arrangement of guiding members in the fixing device according to the present invention.

FIG. 4 shows a definition of arrangement angle of the inlet roller 36. The configuration of the fixing device shown in FIG. 4 is the same as what is shown in FIG. 3 except a part of the configuration member is omitted for the purpose of describing the arrangement angle.

In the embodiment, with the straight line L1 which goes through the point 45 on the upper-stream side of the fixing nip N in the conveyance direction of the recording member and the point 46 on the downstream side of the fixing nip N in the conveyance direction of the recording member being the reference line, the axis of the inlet roller 36 is to be arranged on the line (L2) which is 40 degrees tilted from the portion of the line L1 on the upper-stream side of the fixing nip N in the conveyance direction of the recording member in the direction approaching the heating roller 31 with the point 45 being the center. In the embodiment, the arrangement angle of the inlet roller 36 is the angel between the part of the line L1 on the upper-stream side of the fixing nip N and the line L2. The inlet roller 36 is arranged at the position where it does not come in contact with the upper pressing roller 33.

(Operational Controlling of Fixing Device)

Figure 5:
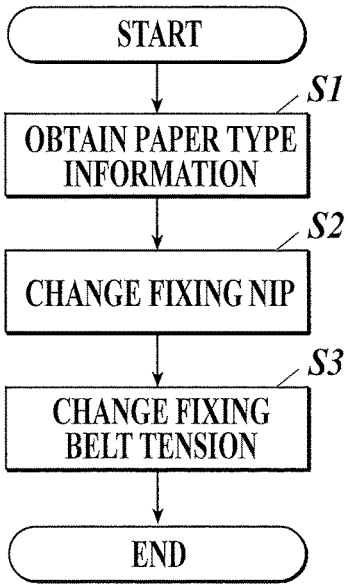
FIG. 5 is a flowchart showing operational control of the fixing device according to the present invention.
Figure 6A:
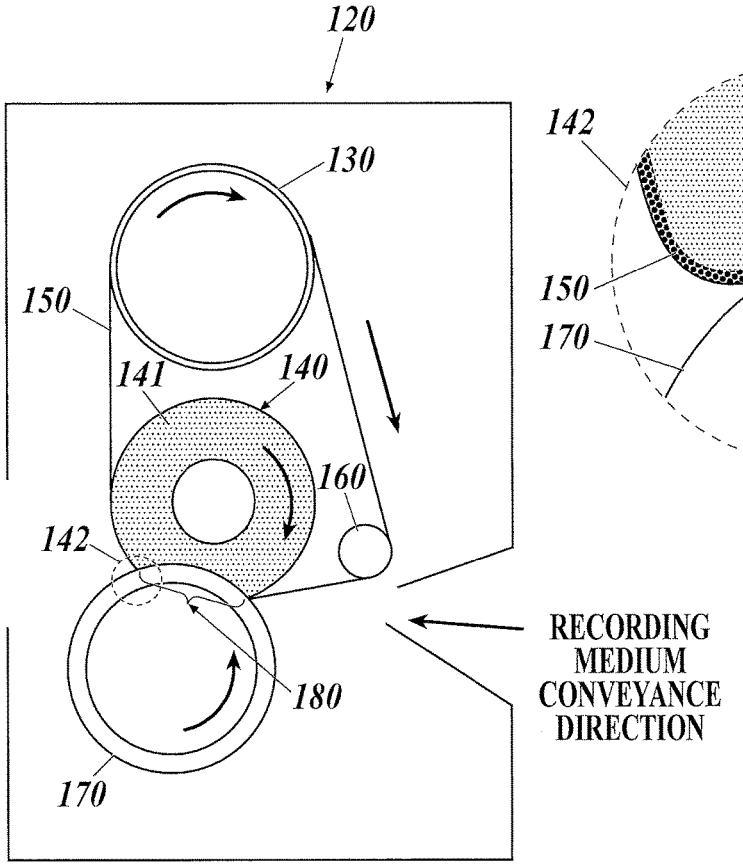
FIG. 6A is used for explaining a mechanism of bad separability and is a cross-sectional view showing a conventional fixing device configuration when a piece of thick paper is to be fed.
Figure 6B:
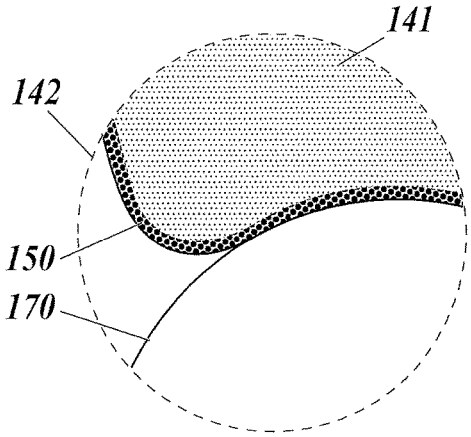
FIG. 6B is used for explaining the mechanism of bad separability and is a cross-sectional view showing a conventional fixing device configuration when a piece of thick paper is to be fed.
Figure 7A:
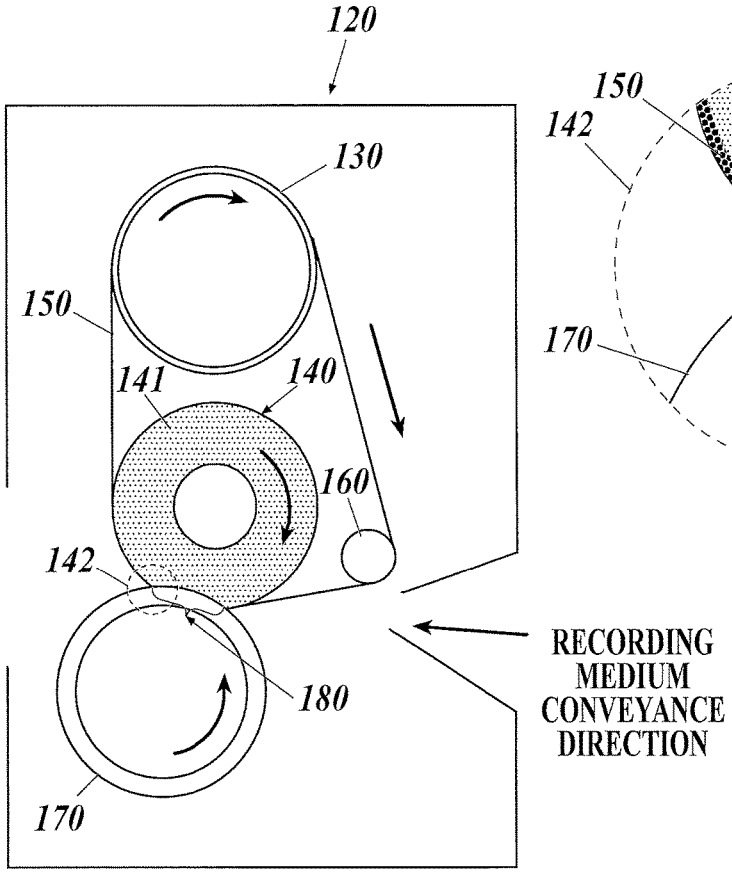
FIG. 7A is used for explaining a mechanism of bad separability and is a cross-sectional view showing a conventional fixing device configuration when a piece of thin paper is to be fed.
Figure 7B:
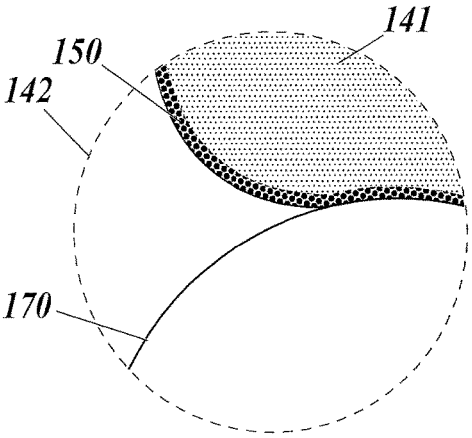
FIG. 7B is used for explaining the mechanism of bad separability and is a cross-sectional view showing a conventional fixing device configuration when a piece of thin paper is to be fed.

FIG. 5 is a flowchart showing the operational controlling of the fixing device according to the present invention.

The operational controlling of the present invention starts at the timing when the control unit S receives a job. After receiving a job, the control unit S obtains paper type information from the job (step S1). On the basis of the correlation table which shows the relation between paper types and the width of the fixing nips N stored in the HDD 104, the control unit S controls the load adjustment mechanism 43 so that the width of the fixing nip N corresponds to the obtained paper type information and changes the width of the fixing nip N (step S2).

Next, on the basis of the correlation table which shows the biasing force of the tension spring 37 that corresponds to the paper type information, the correlation table being stored in the HDD 104, the control unit S controls the tension spring 37 such that the tension spring 37 has the biasing force corresponding to the obtained paper type information and changes the tension of the fixing belt 32 (step S3). After changing the tension of the fixing belt 32 in step S3, the control unit S ends the controlling and the job is to be output. The operational controlling according to the present invention is shown as a flowchart in which the paper type information is obtained and then tension of the fixing belt is changed after the fixing nip is changed. However, this order of changing the tension of the fixing belt and the fixing nip can be in the opposite order or they can be changed at the same timing in the actual operation. Further, it is sufficient that the operational controlling of the present invention is executed before the recording member is conveyed into the fixing nip N.

EXAMPLE

An evaluation conducted by changing the load for forming the fixing nip and the tension of the fixing belt in an image forming apparatus provided with the above described fixing device will be shown below.

[Evaluation]

Load for forming the fixing nip N and tension of the fixing belt 32 were changed and then, two types of recording members were fed through and their separability was observed. Evaluation was made as follows: good separability was evaluated as "0" and bad separability was evaluated as "x".

[Evaluation Conditions]

Image forming apparatus: bizhub PRESS C1100

Fixing temperature: 180° C.

Paper feeding speed: 500 mm/s

Formed image: a solid image of blue (mixed color of (M) color toner and (C) color toner) (printing percentage with respect to a recording member: 100%)

Toner attachment amount: 8±0.2 gsm

Recording Member:

Coated paper: basis weight of 85 gsm, grain direction: long grain paper, size: A3

High-quality paper: basis weight of 81 gms, grain direction: long grain paper, size A3

[Evaluation Result]

The evaluation results are shown in table 1.

TABLE 1

| EXPERIMENT | LOAD (N) | FIXING BELT TENSION (N) | SEPARABILITY COATED PAPER | SEPARABILITY HIGH-QUALITY PAPER |
|---|---|---|---|---|
| 1 | 220 | 250 | ○ | ○ |
| 2 | 1500 | 250 | x | x |
| 3 | 1500 | 175 | x | ○ |
| 4 | 1500 | 100 | ○ | ○ |
| 5 | 1500 | 50 | ○ | ○ |

The condition in Experiment 1 is the setting condition of load and fixing belt tension when a piece of thick paper is to be fed. In Experiments 2 to 5, in order to make the fixing temperature difference between thick paper and thin paper be small, tension of the fixing belt 32 is changed in a state where the load required for realizing the fixing nip N needed when feeding a piece of thin paper is lowered to 1500N. The coated paper used in the above evaluation is a recording member which can clearly detect the bad influence of changes in fixing nip and fixing belt tension due to its great surface nature. That is, if the fixing nip is made small by decreasing the load, the separability deteriorates greatly. Therefore, pieces of paper are fed to detect their separability.

As shown in the evaluation results in table 1, under the setting condition of Experiment 1, the curvature of the fixing belt 32 is large since a downward convex shape bulged part is formed near the exist side of the fixing nip N, therefore, an evaluation sheet can be separated even if it is fed under evaluation condition that is disadvantageous with respect to separability. On the other hand, when the fixing belt tension is lowered from 250N which is the setting when a piece of thick paper is to be fed in a state where the load is decreased to 1500N, in order to obtain the separability comparable to that under the condition of Experiment 1 which is the setting condition when a piece of thick paper is to be fed, the fixing belt tension needs to be lowered to 100N in the case where a piece of coated paper is to be fed. In the case of a piece of high-quality paper, the fixing belt tension needs to be lowered to 175N. The width of the fixing nip N is 18 mm when the fixing belt tension and the load are lowered to the point where the recording member can be separated.

When the load between the upper pressing roller 33 and the lower pressing roller 34 is made small, the bulged part formed near the exit side of the fixing nip N is small. Therefore, the curvature of the fixing belt 32 becomes small and the separability deteriorates. However, by making the fixation belt tension be small with decreasing of the load small, the elastic rubber of the elastic layer 39 which has been pulled up by the tension of the fixing belt 32 is to be released toward the inner circumference side of the loosened fixing belt 32 with the loosening of the fixing belt 32. Therefore, the curvature at the exit side of the fixing nip N can be made large as that in the setting for feeding a piece of thick paper. Thus, separability can be maintained even if the fixing nip N is made small by decreasing the load.

As described above, in the embodiment, the fixing load is made small to make the fixing nip N small and the tension of the fixing belt 32 is made small to loosen the fixing belt at near the exit side of the fixing nip N in order to ensure the curvature. However, making the tension of the fixing belt 32 be small is effective not only for ensuring the separation curvature. In a case where it is switched to feeding a piece of thin paper from feeding a piece of thick paper, although the fixing temperature for thin paper is set to higher temperature than the conventional set temperature, the heat needed for fixation is transmitted to the recording member on which a not-yet-fixed toner is transferred in a very short period of time since the width of the fixing nip N in the feeding direction is short. In such a case, the toner on the recording member melts at once to be fixed and then the toner is cooled suddenly by coming in contact with outside air right after fixation when a fixing device of conventional configuration is used. Therefore, there is a possibility that parts where bonding of toner is weak and still in a melted state remains among the fixing toner and that a part of toner transfers onto the fixing belt 32 side.

On the other hand, in the fixing device having the configuration of the embodiment, the toner to be fixed onto the recording member in the fixing nip N will not be suddenly cooled by coming in contact with outside air since the recording member comes in contact with the loosened part of the fixing belt 32 right after the exit side of the fixing nip N, and the toner is cooled gradually to be surely fixed and toner can be prevented from transferring onto the fixing belt 32 side. That is, loosening of the tension in the fixing belt N has a good influence not only for assuring separability of the recording member but also for image quality.

As described above, according to the above described fixing device and image forming apparatus, the curvature of the fixing belt 32 near the exit of the nip can be assured by making the tension of the fixing belt 32 be small with the load due to the under pressing roller 34 pressing against the upper pressing roller 33 becoming small in order to make the fixing nip N small. Therefore, fixation and separation can be prevented from becoming deteriorated even if the fixing temperature for thin paper is set at a high temperature. Further, the time needed for switching the fixing temperature according to the type of paper can also be shortened. Therefore, productivity of printed documents can be prevented from decreasing.

The fixing device according to the embodiment is provided with the inlet roller 36. However, the configuration may be such that the fixing belt is wound around the heating roller 31 and the upper pressing roller 33, the inlet roller 36 not being provided, for example. Further, the number of members which the fixing belt is to be wound around is not limited and therefore, there may be a plurality of members.

The entire disclosure of Japanese Patent Application No. 2014-251762 filed on Dec. 12, 2014 is incorporated herein by reference in its entirety.

What is claimed is:

1. A fixing device, comprising:

a first pressing member having an elastic layer;

a fixing belt wound around the first pressing member;

a second pressing member which presses against the first pressing member via the fixing belt and forms a fixing nip, the second pressing member and the fixing belt sandwiching a recording member to convey the recording member;

a load adjustment unit which adjusts pressing load of the first pressing member and the second pressing member;

a tension adjustment unit which adjusts tension of the fixing belt; and a control unit which, on a basis of information on the recording member, controls the load adjustment unit so as to change a width of the fixing nip in a recording member conveyance direction and controls, along with the controlling of the load adjustment unit, the tension adjustment unit so as to change the tension of the fixing belt and maintain a predetermined curvature of the fixing belt near an exit of the fixing nip;

wherein the tension adjustment unit is operably connected to a heating roller, about which the fixing belt is wound; and the load adjustment member is operably connected to the second pressing member or the first pressing member.

2. The fixing device of claim 1, wherein the control unit, on the basis of the information on the recording member, changes an adjustment value of the load adjustment unit and changes an adjustment value of the tension adjustment unit.

3. The fixing device of claim 1, wherein the information on the recording member is a basis weight, and in a case where the basis weight is smaller than or equal to a predetermined value, the control unit controls the load adjustment unit so that a width of the fixing nip in the recording member conveyance direction be small and controls the tension adjustment unit so as to lower the tension of the fixing belt.

4. The fixing device of claim 1, further comprising a guiding unit which is arranged at a position suitable to separate the fixing belt from the first pressing member, the position being on an inner circumference of the fixing belt and being on an entrance side of the fixing nip with respect to the recording member conveyance direction of a piece of paper fed into the fixing nip.

5. The fixing device of claim 4, wherein the control unit moves the guiding member on a basis of controlling of the load adjustment unit and the tension adjustment unit.

6. The fixing device of claim 4 wherein the guiding member is arranged at a position tilted 40 degrees toward a direction approaching the first pressing roller with a point in an upper stream side of the fixing nip in the recording member conveyance direction being a center and a first straight line that passes through the point in the upper stream side and a point in a downstream side of the fixing nip in the recording member conveyance direction being a reference line.

7. An image forming apparatus, comprising:

a toner image forming unit which forms a toner image on an image supporting body;

a transfer unit which transfers the toner image formed by the toner image forming unit onto a recording member;

a first pressing member which includes an elastic layer;

a fixing belt which is wound around the first pressing member;

a second pressing member which presses against the first pressing member via the fixing belt and forms a fixing nip, the second pressing member and the fixing belt sandwiching the recording member to convey the recording member;

a load adjustment unit which adjusts pressing load of the first pressing member and the second pressing member;

a tension adjustment unit which adjusts tension of the fixing belt; and a control unit which, on a basis of information on the recording member, controls the load adjustment unit so as to change a width of the fixing nip in a recording member conveyance direction and controls, along with the controlling of the load adjustment unit, the tension adjustment unit so as to change the tension of the fixing belt and maintain a predetermined curvature of the fixing belt near an exit of the fixing nip;

wherein the tension adjustment unit is operably connected to a heating roller, about which the fixing belt is wound; and the load adjustment member is operably connected to the second pressing member or the first pressing member.

* * * * *